United States Patent [19]

Brooks

[11] Patent Number: 4,587,029

[45] Date of Patent: May 6, 1986

[54] INTERMEDIATE PRODUCT FOR USE IN PRODUCING A DETERGENT BAR

[75] Inventor: Burton Brooks, Bellevue, Wash.

[73] Assignee: The Chemithon Corporation, Seattle, Wash.

[21] Appl. No.: 672,080

[22] Filed: Nov. 16, 1984

Related U.S. Application Data

[62] Division of Ser. No. 508,131, Jun. 27, 1983, Pat. No. 4,515,707.

[51] Int. Cl.[4] ..... C11D 17/06; C11D 1/12

[52] U.S. Cl. ..... 252/91; 252/174; 252/174.13; 252/174.14; 252/368; 252/531; 252/559; 252/DIG. 16

[58] Field of Search ..... 252/559, 174, DIG. 16, 252/531, 550, 368, 174.14, 174.13, 91

[56] References Cited

U.S. PATENT DOCUMENTS 3,425,948 2/1969 Otrhalek ..... 252/132

4,515,707 5/1985 Brooks ..... 252/368

OTHER PUBLICATIONS

Technical Data, "Dry Neutralization", FMC Chemicals, Ralph S. Webber.

*Primary Examiner*—John E. Kittle
*Assistant Examiner*—Mukund J. Shah
*Attorney, Agent, or Firm*—Marshall, O'Toole, Gerstein, Murray & Bicknell

[57] ABSTRACT

Anhydrous fatty alcohol sulfuric acid or ethoxylated fatty alcohol sulfuric acid is neutralized with dry sodium carbonate powder in the presence of powdered sodium tripolyphosphate in a high shear mixer. The dry, powdered, neutralized reaction product is stored until required for use in the manufacture of a detergent bar whereupon the powder is mixed with liquid ingredients for the detergent bar and subjected to conventional manufacturing steps for a detergent bar. Other dry, powdered ingredients for the detergent bar may be introduced at the high shear mixer.

10 Claims, 1 Drawing Figure

INTERMEDIATE PRODUCT FOR USE IN PRODUCING A DETERGENT BAR

This is a division of application Ser. No. 508,131, filed Jun. 27, 1983 U.S. Pat. No. 4,515,707.

BACKGROUND OF THE INVENTION

The present invention relates generally to the manufacture of detergents and more particularly to a method for producing a laundry detergent bar and to an intermediate product for use in the manufacture of a laundry detergent bar.

Laundry detergents, including laundry detergent bars, contain a surface active ingredient which is usually produced by reacting a liquid organic material with sulfur trioxide to produce a sulfonic or sulfuric acid of the liquid organic material and then neutralizing the acid to produce a salt of the sulfonic acid or sulfuric acid. That salt is the surface active ingredient in the laundry detergent.

Typical liquid organic materials used in the production of surface active ingredients for laundry detergents are alkyl benzene and $C_{8-20}$ fatty alcohols or ethoxylated derivatives of said fatty alcohols. When alkyl benzene is reacted with $SO_3$, the reaction is called sulfonation and the reaction product is alkyl benzene sulfonic acid; and when the latter is neutralized (e.g., with sodium hydroxide), the resulting salt is sodium alkyl benzene sulfonate.

When a $C_{8-20}$ fatty alcohol or an ethoxylated derivative thereof is reacted with $SO_3$, the reaction is called sulfation, and the reaction product is a sulfuric acid of the fatty alcohol or ethoxylated derivative thereof; and when the sulfuric acid is neutralized (e.g., with sodium hydroxide) the resulting reaction product is a sodium salt of the sulfuric acid. As used herein, the term "fatty alcohol sulfuric acids" includes both true fatty alcohol sulfuric acids and ethoxylated fatty alcohol sulfuric acids, unless the context indicates otherwise.

A sulfonation or sulfation process may require a digestion period to complete the reaction to the extent desired, although for sulfation, the digestion period, if there is one, is usually relatively short if not absent.

The surface active ingredient is only one of the ingredients of a laundry detergent bar. Other ingredients, both solid and liquid, are mixed with the surface active ingredient, and this mixture is then subjected to other processing steps, conventional in the manufacture of laundry detergent bars, such as refining, extruding, cutting, conditioning and stamping.

It is desirable that the bar manufacturing process be conducted independently of the reaction process for producing the sulfonic or fatty acid sulfuric acid, so as to insure continuous, uninterrupted production of one processing system should the other be shut down due to mechanical difficulties. In order to uncouple these two processes, it must be possible to store the reaction product resulting from the sulfonation or sulfation process. When the reaction product is sulfonic acid, there is no problem with storage because the sulfonic acid does not degrade or break down during storage. Alkyl benzene sulfonic acid, in the concentration normally utilized for making laundry detergent bars, can be readily pumped from the sulfonation processing line to a storage container where the sulfonic acid can be held until it is needed in the bar manufacturing process at which time the sulfonic acid is neutralized and the resulting sulfonate is then fed into the mixer for the bar manufacturing process.

In contrast, fatty alcohol sulfuric acid or the sulfuric acid of ethoxylated derivatives of the fatty alcohol are not stable during storage and break down to common sulfuric acid ($H_2SO_4$) and "oil." In order to provide a stable, storable product, these fatty alcohol sulfuric acids must be neutralized, and they should be neutralized with sufficient immediacy following the completion of the sulfation reaction to prevent said breakdown or other problems which arise when they are not immediately neutralized.

When the above-described fatty alcohol sulfuric acids are neutralized in the conventional manner with sodium hydroxide, an aqueous slurry is formed. The viscosity of this neutralized slurry, and the ease with which this slurry can be stored and handled depend upon the solids content or concentration of this slurry, i.e., the amount of surface active ingredient in the slurry.

When the laundry detergent bar contains neutralized fatty alcohol sulfuric acid as the surface active ingredient, it is important that the bar contain a percentage of that surface active ingredient corresponding to the percentage of surface active ingredient which is present when the detergent bar contains alkyl benzene sulfonate as the surface active ingredient. A typical alkyl benzene sulfonate content for laundry detergent bars is in the range 26–32 wt. %, and a typical water content for such bars is in the range 3–12 wt. %. The amount of neutralized fatty alcohol sulfuric acid required to replace that amount of alkyl benzene sulfonate, at the water content indicated, requires a neutralized slurry concentration in the range of about 71–90%. At this concentration, the solids content and viscosity of the neutralized slurry are so high as to render the neutralized slurry very difficult to handle from a pumping and storage standpoint. Such a viscous slurry requires heated, agitated storage containers with heat-traced conduits and pumps capable of handling high solids content slurries. This equipment is relatively expensive.

Because alkyl benzene is derived from petroleum whereas fatty alcohols or the ethoxylated derivatives of fatty alcohols are not, there are many instances where it is desirable to employ, in a laundry detergent bar, surface active ingredients manufactured from fatty alcohols or their ethoxylated derivatives rather than from alkyl benzene.

SUMMARY OF THE INVENTION

The present invention enables the utilization of surface active ingredients manufactured from fatty alcohols or the ethoxylated derivatives thereof while eliminating the storage and handling problems associated with viscous slurries containing the salts of fatty alcohol sulfuric acids or of ethoxylated fatty alcohol sulfuric acids. This is accomplished by providing the neutralized salt of the fatty alcohol sulfuric acid in the form of a dry, free-flowing powder. This salt is produced by mixing an anhydrous fatty alcohol sulfuric acid with a dry, powdered neutralizing agent, e.g., sodium carbonate, in a reaction and under conditions which substantially avoid the formation and/or presence of free water in the neutralized product. The neutralization step is performed immediately, without storage of the fatty alcohol sulfuric acid or other delay, following completion, to the extent desired, of the sulfation reaction in which the fatty alcohol sulfuric acid is produced.

Sodium tripolyphosphate (STPP) is a conventional ingredient in a laundry detergent bar. STPP is employed in the neutralizing step by mixing the anhydrous sulfuric acid with dry, powdered STPP at the beginning of the neutralizing step. It is believed that the STPP initially adsorbs the sulfuric acid and that the STPP then acts as a medium for transferring the sulfuric acid to the neutralizing agent for performance of the neutralizing reaction. It is important that all of the STPP employed in the neutralizing step be in a form known as "powdered" STPP (or STPP "powder") as distinguished from a form known as "granular" STPP both of which forms are available commercially under those names. Powdered STPP provides a much larger surface area on which to adsorb the sulfuric acid, and powdered STPP facilitates the neutralization reaction compared to granular STPP. In addition, powdered STPP is much more absorptive than granular STPP.

The ingredients which enter into the neutralizing reaction are subjected to high shear mixing, and other dry ingredients intended for use in the laundry detergent bar may be subjected to the same high shear mixing at the same time.

The neutralizing reaction generates heat. To prevent the neutralized powder from becoming plastic during the neutralizing operation, a neutralizing temperature of less than about 160° F. (71° C.) should be maintained.

The cooled, neutralized powder can be readily conveyed to a storage container, such as a bin where it is stored until required for use in the bar manufacturing process. At that time, the powder is removed from the storage bin, mixed with liquid and other ingredients intended for inclusion in the laundry detergent bar and then subjected to the usual sequence of conventional bar manufacturing steps.

None of the liquid ingredients for the laundry detergent bar should be mixed with the anhydrous fatty alcohol sulfuric acid in the neutralization mixing step, and preferably, all of the dry, powdered ingredients for the laundry detergent bar are mixed with the fatty alcohol sulfuric acid in the neutralization mixing step.

As noted above, sodium carbonate is the preferred neutralizing agent because no water is formed in a neutralizing reaction employing sodium carbonate, as will be explained below. When dilute sodium hydroxide (e.g., 50% NaOH) is used as a neutralizing agent, water is present and is also a neutralization reaction product. Because the presence of free water in a dry, neutralized product should be avoided or minimized, the use of sodium hydroxide in a dry, neutralizing step is limited.

Sodium tripolyphosphate hydrates with water to form sodium tripolyphosphate hexahydrate, and STPP will tie up about 25% of its weight in water. Therefore, some sodium hydroxide can be used in a dry, neutralizing step so long as there is also used sufficient sodium tripolyphosphate to tie up substantially all of the free water which is present as a result of the neutralizing step. The amount of sodium hydroxide, at a given concentration, which can be used as a neutralizing agent is determined by the amount of STPP which can be used at the neutralizing step, and this is determined by the percentage of STPP which is desired or permitted in the laundry detergent bar.

To completely prevent the formation of water as a result of the neutralization step, the neutralizing agent should consist entirely of dry sodium carbonate, and sufficient sodium carbonate neutralizing agent should be provided to (a) effect complete neutralization of all of the fatty alcohol sulfuric acid and (b) form sodium bicarbonate with all of the carbonate ions and hydrogen ions which become available during the neutralization step.

No additive liquid water is necessary to initiate or sustain the neutralizing reaction when the totality of ingredients mixed with the anhydrous sulfuric acid at the neutralizing step are in dry, powdered form. In such a case, completion of the neutralization reaction requires about 30 minutes, and the neutralization reaction mixture may be subjected to an aging step after mixing to complete the reaction. The reaction mixture may be cooled during aging.

The powder produced by the neutralizing step is an intermediate product for use in the production of a detergent bar. This intermediate product comprises a sodium salt of a sulfuric acid selected from the group consisting of $C_{8-20}$ fatty alcohol sulfuric acids and ethoxylated $C_{8-20}$ fatty alcohol sulfuric acids. The product also contains sodium bicarbonate, there being at least one mol of sodium bicarbonate for each mol of sodium salt of the fatty alcohol sulfuric acid produced by neutralization with sodium carbonate. The product has a dry, powdered form and is substantially devoid of free water and of fatty alcohol sulfuric acid. There may also be included in the intermediate product at least one other dry ingredient intended for inclusion in a detergent bar, but there are no liquid laundry detergent bar ingredients in the intermediate product.

The process for producing this intermediate product may be continuous.

Other features and advantages are inherent in the inventions claimed and disclosed or will become apparent to those skilled in the art from the following detailed description in conjunction with the accompanying diagrammatic drawing.

DETAILED DESCRIPTION

Figure 1:
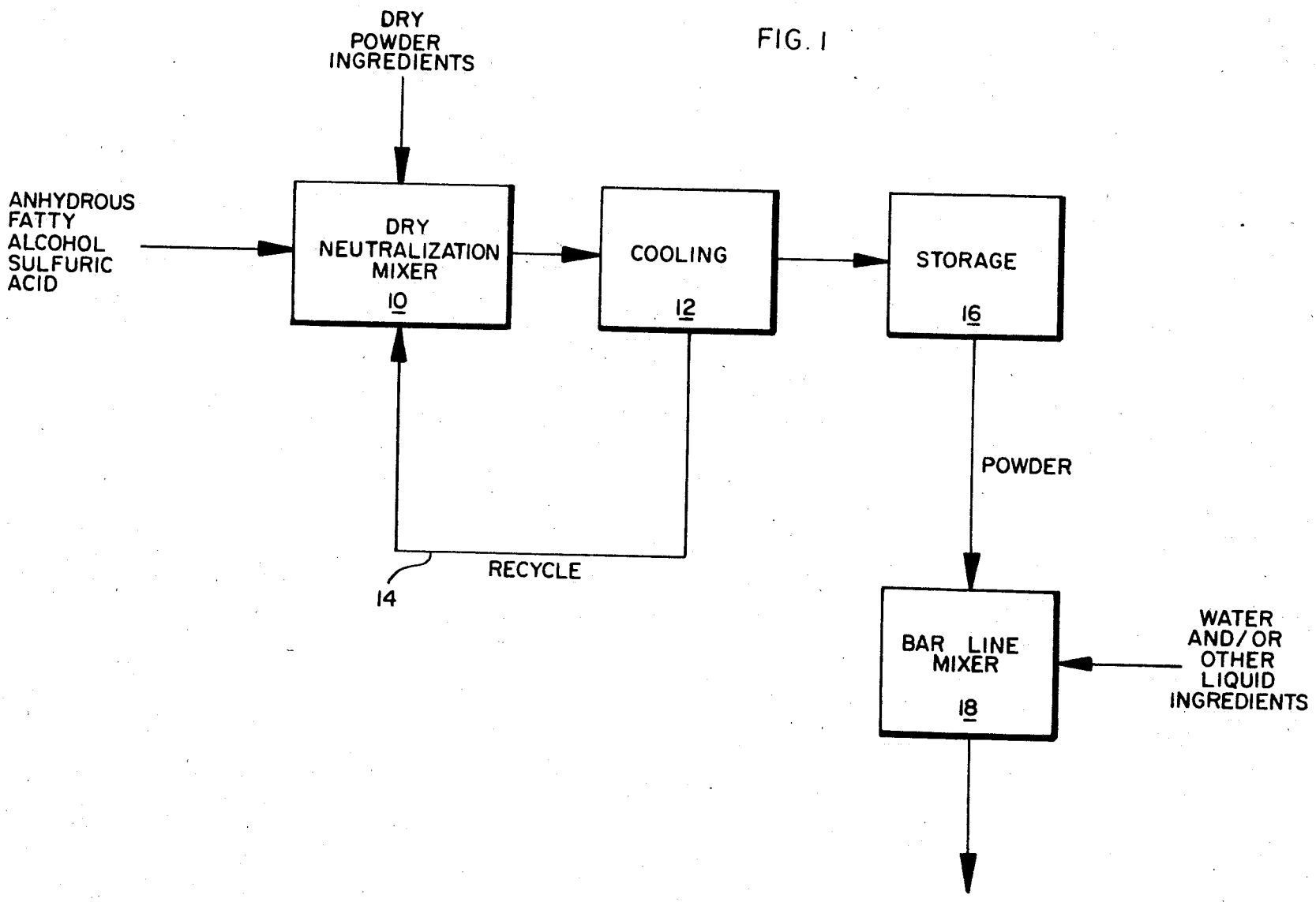
FIG. 1 is a schematic diagram illustrating a portion of a laundry detergent bar manufacturing process in accordance with the present invention.

A method in accordance with the present invention is intended for use in the production of laundry detergent bars containing the salt of a sulfuric acid selected from the group consisting of $C_{8-20}$ fatty alcohol sulfuric acids and ethoxylated $C_{8-20}$ fatty alcohol sulfuric acids. These fatty alcohol sulfuric acids are formed by reacting an appropriate fatty alcohol or ethoxylated derivative thereof with sulfur trioxide. Generally, fatty alcohols containing from about 8 to about 20 carbon atoms include octyl alcohol, decyl alcohol, lauryl alcohol, tridecyl alcohol, tetradecyl alcohol, cetyl alcohol, tallow alcohol, octadecyl alcohol, and eicosyl alcohol. Ethoxylated derivatives of the above fatty alcohols include polyoxyethylene ethers of lauryl alcohol and tridecyl alcohol.

FIG. 1 illustrates, in flow diagram form, a portion of a laundry detergent bar manufacturing process which utilizes the fatty alcohol sulfuric acids described in the preceding paragraph.

The fatty alcohol sulfuric acid is supplied to the process as an anhydrous liquid, and it is mixed with laundry detergent bar ingredients which are in dry, powdered form. These ingredients include a dry, powdered neutralizing agent for the fatty alcohol sulfuric acid, namely sodium carbonate. Another dry, powdered ingredient is sodium tripolyphosphate.

The neutralization takes place in a dry, neutralization mixer 10 which subjects the fatty alcohol sulfuric acid and the dry, powdered ingredients to high shear mixing by mixing blades which rotate at a speed in the range 1,000–3,000 rpm, for example. A conventional food processor, of the type found in the kitchens of many homes, is an example of a high shear mixer (on a small scale). An example of an industrial high shear mixer which may be employed in the present invention comprises an outer drum which rotates about a horizontal axis at a speed of about 23 rpm and which has inner agitator blades rotating about an axis coaxial with that of the drum and at a speed of about 2700 rpm.

During the neutralizing step, dry, powdered sodium tripolyphosphate is mixed with the anhydrous sulfuric acid. It is believed that the powdered STPP initially adsorbs the sulfuric acid and that the STPP then acts as a medium for transferring the sulfuric acid to the neutralizing agent for performance of the neutralizing reaction.

The employment of powdered STPP during the neutralizing operation is also desirable for other reasons. It reduces lumpiness in the neutralization reaction product, it hastens the neutralization reaction and it improves the dispersion or mixing of the sulfuric acid throughout the neutralization reaction mixture. The STPP should be in fine, powdered form, as distinguished from granular form, so that the surface area available for adsorbing the sulfuric acid is relatively large.

The desired neutralization reaction product is the sodium salt of the fatty alcohol sulfuric acid introduced into mixer 10. When sodium carbonate ($Na_2CO_3$) is employed as the neutralizing agent, the sodium carbonate reacts with the sulfuric acid, and the resulting neutralization reaction will produce one mol of the sodium salt of that sulfuric acid plus one mol of sodium bicarbonate ($NaHCO_3$), both of which are solids. The production of sodium bicarbonate as a result of the neutralization reaction is important because it prevents the formation of water the presence of which should be minimized when, as here, the desired end product is intended to be a free-flowing powder.

More particularly, when a carbonate is employed as the neutralizing agent, the positive ion from the carbonate replaces a hydrogen ion ($H^+$) in the fatty alcohol sulfuric acid. Also present is a carbonate ion ($CO_3^{--}$). Unless the carbonate ion is tied up by a positive ion having two plus charges or two positive ions having one plus charge apiece, the carbonate ion will decompose into carbon dioxide ($CO_2$) and an oxygen ion ($O^{--}$), and this oxygen ion will combine with hydrogen ions available from the fatty alcohol sulfuric acid as a result of the neutralization reaction, to form water, which is undesirable. However, when sodium carbonate is utilized as the neutralizing agent, there are two sodium ions ($Na^+$) present for each molecule of sodium carbonate. Only one sodium ion is needed to replace each hydrogen ion given off by the sulfuric acid during the neutralization reaction. The second sodium ion is available to combine with one hydrogen ion and with the carbonate ion to form sodium bicarbonate, thereby preventing the hydrogen ion and the carbonate ion from forming carbon dioxide and water. In summary, when sodium carbonate is employed as the neutralizing agent, the neutralization reaction produces, in addition to the sodium salt of the fatty alcohol sulfuric acid, sodium bicarbonate; and no water is produced.

Sodium bicarbonate is a conventional dry ingredient of laundry detergent bars, and so is sodium carbonate, so there is nothing undesirable about employing sodium carbonate in amounts in excess of that required for the neutralizing reaction (e.g., a 25–100% excess) thereby providing the neutralized product with sodium carbonate as one of the dry, powdered ingredients thereof. In summary, the mols of sodium carbonate present in the product may range from 0 up to 100% of the number of moles of sodium bicarbonate in the product.

In one preferred embodiment, sufficient sodium carbonate is provided to neutralize all of the fatty alcohol sulfuric acid. In this embodiment there should be at least one mol of sodium carbonate for each mol of fatty alcohol sulfuric acid. The resulting reaction produces the sodium salt of the fatty alcohol sulfuric acid plus one mol of sodium bicarbonate for every mol of the aforementioned sodium salt of the fatty alcohol sulfuric acid. This reaction product is in dry, powdered form and is substantially devoid of water and of fatty alcohol sulfuric acid, for the reasons described above.

In addition to that embodiment of the present invention using sodium carbonate as the sole neutralizing agent, other embodiments may employ sodium hydroxide as a neutralizing agent so long as there is sufficient STPP present during neutralization to tie up substantially all of the free water which is present as a result of employing the sodium hydroxide in the neutralizing step. STPP will tie up an amount of water equal to about 25% of the weight of the STPP. If the dry, neutralized product also contains sodium carbonate (resulting from the addition of sodium carbonate in excess of that employed in the neutralization reaction), that sodium carbonate also will tie up some water (sodium bicarbonate will not tie up water). In the absence of STPP in the dry, neutralized product and in the presence of sodium carbonate in amounts reflecting a percentage normally included in laundry detergent bar formulations, about 2–3 wt. % water can be accommodated (i.e., tied up) in the dry, neutralized product. When, in accordance with the present invention, STPP is also present in the dry, neutralized product, in amounts reflecting a percentage normally included in laundry detergent bar formulations, up to about 10 wt. % water can be accommodated in the dry, neutralized product.

When sodium carbonate is used as the sole neutralizing agent and all the ingredients mixed with the anhydrous sulfuric acid at the neutralizing step are in dry, powdered form, the neutralizing reaction will proceed without additive liquid water. Completion of the neutralizing reaction under these conditions requires about 30 minutes, and the neutralization reaction mixture may be subjected to aging after mixing to complete the reaction.

In summary, in the most basic form of the present invention, the only ingredients which need be mixed with the anhydrous sulfuric acid in the neutralization operation are dry, powdered sodium carbonate and STPP in powdered form. (Conceivably, the STPP could be dispensed with as it does not enter chemically into the neutralization reaction involving the sodium carbonate, but STPP should be used, and the use of powdered STPP at the neutralizing step is an important feature of the present invention.) In other embodiments, some sodium hydroxide may be employed, as explained above.

The resulting dry, powdered neutralization reaction product contains the sodium salt of the sulfuric acid and, in the most basic form of the present invention, sodium bicarbonate and nothing more, although powdered STPP should also be present. Sodium carbonate will be present when used in amounts exceeding that employed for neutralizing purposes. When sodium hydroxide is employed as a neutralizing agent, the neutralization reaction product will contain some water, but only an insubstantial amount of free water, due to restrictions on the amount of sodium hydroxide which may be used and due to the action of the STPP in tieing up free water.

In addition to the dry, powdered neutralization reaction product described above, the laundry detergent bar may contain other ingredients in dry, powdered form. These include calcium carbonate, talc, disodium phosphate, sodium pyrophosphate, sodium sulfate, and the like. These other ingredients in dry, powdered form may be added to the ingredients which are mixed at the dry, neutralization mixer 10.

The neutralization reaction generates heat, although neutralization with sodium carbonate generates less heat than does neutralization with sodium hydroxide. Because the neutralization reaction product becomes plastic at a temperature above about 160° F. (71° C.) it may be necessary to employ cooling in connection with the neutralization operation. This may be accomplished by subjecting the dry powder resulting from the neutralization operation to a cooling operation indicated at 12 in FIG. 1. The cooling operation may employ conventional cooling apparatus utilized to cool powders, such as air lift belts, cooling drums and the like. The powder is cooled at 12 to a temperature in the range of about 75°–100° F. (24°–38° C.). The powder which has undergone cooling at 12 is then divided into two portions. One portion (e.g., 40–60%) is recycled via a conduit 14 back to the dry, neutralization mixer 10 to cool the ingredients undergoing neutralization during the mixing step. As a result, the dry, neutralized powder which is withdrawn from mixer 10 has a temperature no greater than about 160° F. (71° C.). Typically this powder has a temperature in the range 135°–160° F. (57°–71° C.).

As an alternative to, or in addition to, cooling by recycling, cooling can be accomplished by externally cooling mixer 10 in a conventional manner.

The neutralization reaction mixture which leaves mixer 10 undergoes aging during cooling by recycling, at 12.

Following cooling, that portion of the dry, neutralized powder which is not employed for recycling purposes, is stored in conventional storage containers (e.g., bins or hoppers) indicated in FIG. 1 at 16. Storage of the dry neutralized powder enables the process and apparatus for manufacturing the detergent bar to be operated independently of the process and apparatus for producing the dry, neutralized powder. A shutdown of the detergent bar manufacturing operation downstream of the storage containers at 16 will not require a shutdown of the process for manufacturing dry, neutralized powder upstream of the storage containers at 16. Similarly, a shutdown of the manufacturing process upstream of the storage containers at 16 will not require a shutdown of the bar manufacturing operation downstream of the storage containers at 16.

Dry, neutralized powder is removed from storage at 16 as required and is then introduced into a bar line mixer at 18 along with water and/or other liquid ingredients conventionally employed in the manufacture of a detergent bar. Typical examples of such other liquid ingredients are magnesium sulfate solution and sodium silicate solution. None of the water and/or other liquid ingredients are mixed with the dry powder ingredients or with the fatty alcohol sulfuric acid in the dry, neutralization mixer 10.

Other surface active ingredients, in the form of liquids or pastes may be added at this stage. These include sodium alkyl benzene sulfonate in dilute form (e.g., a paste containing 30–40 wt. % sodium alkyl benzene sulfonate) which facilitates the mixing operation at this stage and offsets, in the final laundry detergent bar, brittleness which can be caused by the alcohol sulfate in the bar. Other laundry detergent bar ingredients which may be added at this stage include triethanol amine, diatomaceous earth and other fillers, and small portions of dye, perfume and optical brighteners.

After the powder removed from storage at 16 is mixed with water and/or other liquid ingredients at 18, the resulting mixture is subjected to further processing into a laundry detergent bar. These additional processing steps are conventional and comprise, for example, the steps of refining, extruding, cutting, conditioning and stamping.

A method in accordance with the present invention is particularly applicable where the sulfuric acid employed is $C_{12-18}$ coconut fatty alcohol sulfuric acid.

Another sulfuric acid to which the method of the present invention is particularly applicable is $C_{12-14}$ lauryl alcohol sulfuric acid.

The ethoxylated alcohol sulfuric acids to which the method of the present invention is particularly applicable comprise one mol to three mol ethoxylated $C_{8-20}$ fatty alcohol sulfuric acids. These include 1.2 mol ethoxylated $C_{10-14}$ alcohol sulfuric acid, 2.5 mol ethoxylated $C_{8-10}$ alcohol sulfuric acid, and 3 mol ethoxylated $C_{10-12}$ sulfuric acid.

In all cases, whether the sulfuric acid is a fatty alcohol sulfuric acid or ethoxylated fatty alcohol sulfuric acid, the sulfuric acid is anhydrous to minimize the presence of water in the powdered neutralization reaction product.

Examples of ingredient formulations which are introduced at dry, neutralization mixer 10 when practicing a method in accordance with the present invention are set forth in the following Table I.

TABLE I

| | Wt.% | | | | |
|---|---|---|---|---|---|
| INGREDIENT | I | II | III | IV | V |
| $C_{12-18}$ coconut fatty alcohol sulfuric acid | 34.6% | 30.1% | 15.1% | — | — |
| $C_{12-14}$ lauryl alcohol sulfuric acid | — | — | — | 29.7% | 17.5% |
| $Na_2CO_3$ | 27.9% | 24.3% | 12.1% | 24.8% | 14.6% |
| Sodium Tripolyphosphate | 15.0% | 26.1% | 13.1% | 25.7% | 15.2% |
| $CaCo_3$ | 15.0% | 13.0% | 6.5% | 12.9% | 7.6% |
| Talc | 7.5% | 6.5% | 3.2% | 6.9% | 4.1% |
| Recycle | — | — | 50% | — | 40.9% |
| | 100% | 100% | 100% | 100% | 100% |

Except for the anhydrous fatty alcohol sulfuric acid, all of the ingredients set forth in the foregoing table, are in dry, powdered form, including the recycle.

In the embodiment illustrated in FIG. 1, the process for manufacturing the dry, neutralized powder, upstream of the storage containers at 16, is a continuous process.

The foregoing detailed description has been given for clearness of understanding only, and no unnecessary limitations should be understood therefrom, as modifications will be obvious to those skilled in the art.

I claim:

1. A storable, intermediate product for use in the production of a laundry detergent bar, said product comprising:

from 0 to 10 wt. % water;

the remainder being primarily (a) the sodium salt of a sulfuric acid selected from the group consisting of $C_{8-20}$ fatty alcohol sulfuric acids and ethoxylated $C_{8-20}$ fatty alcohol sulfuric acids and (b) sodium bicarbonate;

each of said sodium salt and said sodium bicarbonate having a wt. % greater than the wt. % of said water;

said product having a dry, powdered form;

said product being substantially devoid of free water and of said sulfuric acid;

the total number of mols of sodium bicarbonate and water being at least equal to the number of mols of said sodium salt.

2. An intermediate product as recited in claim 1 and further comprising:

water up to 10 wt. %; and sodium tripolyphosphate, in powdered form, in an amount sufficient to tie up the water content.

3. An intermediate product as recited in claim 2 wherein:

substantially all of the sodium tripolyphosphate is in said powdered form.

4. An intermediate product as recited in claim 3 wherein:

substantially all the water which is in said intermediate product is tied up by said powdered sodium tripolyphosphate.

5. An intermediate product as recited in claim 1 and further comprising:

sodium carbonate in mols from 0 up to 100% of the number of mols of sodium bicarbonate in said product.

6. An intermediate product as recited in claim 5 wherein:

the number of mols of sodium carbonate in said product is 25–100% of the number of mols of sodium bicarbonate in said product.

7. An intermediate product as recited in claim 1 wherein:

there is at least one mol of said sodium bicarbonate for each mol of said sodium salt of the sulfuric acid.

8. An intermediate product as recited in claim 1 and further comprising:

water up to 10 wt. %;

powdered sodium tripolyphosphate;

and sodim carbonate in mols from 0 up to 100% of the number of mols of sodium bicarbonate in said product;

said sodium tripolyphosphate being present in an amount sufficient to tie up the water not tied up by said sodium carbonate.

9. An intermediate product as recited in claim 8 wherein:

substantially all of the water in said product is tied up by said sodium tripolyphosphate and said sodium carbonate.

10. An intermediate product as recited in claim 1 and further comprising:

at least one other laundry detergent bar dry ingredient;

there being no other ingredients in said intermediate product.

* * * * *